United States Patent [19]

Djerdjerian

[11] Patent Number: 4,896,881

[45] Date of Patent: Jan. 30, 1990

[54] MULTIPLE PURPOSE EXERCISE APPARATUS SUITABLE FOR HOME USE

[76] Inventor: Girair Djerdjerian, 239 Boulevard Deguire, Apt. 406, Ville St. Laurent, Quebec, Canada, H4N 1P2

[21] Appl. No.: 174,114

[22] Filed: Mar. 28, 1988

[51] Int. Cl.[4] ..... A63B 17/00

[52] U.S. Cl. ..... 272/900

[58] Field of Search ..... 248/225.31, 231.2, 231.4, 248/231.7, 208; 272/900, 62, 144, 116, 117, DIG. 4, 134

[56] References Cited

U.S. PATENT DOCUMENTS

| | | | |
|---|---|---|---|
| 475,697 | 5/1892 | Medart | 272/62 |
| 1,493,548 | 5/1924 | Johnson | 272/62 |
| 2,551,157 | 5/1951 | Price | 248/231.7 X |
| 3,384,368 | 5/1968 | Fenner et al. | 272/62 |
| 3,826,490 | 7/1974 | Mossman | 272/900 X |
| 4,072,308 | 2/1978 | Applegate | 272/117 |
| 4,077,403 | 3/1978 | Steele | 272/900 X |
| 4,109,907 | 8/1978 | Zito | 272/117 |
| 4,116,434 | 9/1978 | Bernstein | 272/900 X |
| 4,229,002 | 10/1980 | Masters | 272/900 X |
| 4,257,590 | 3/1981 | Sullivan et al. | 272/117 |
| 4,286,782 | 9/1981 | Furhop | 272/117 |
| 4,293,127 | 10/1981 | Dudley | 272/133 |
| 4,344,618 | 8/1982 | Dudley | 272/117 |
| 4,358,108 | 11/1982 | Voris | 272/118 |
| 4,358,109 | 11/1982 | Schrems | 272/144 |
| 4,441,706 | 4/1984 | Korzaniewski | 272/134 X |
| 4,564,194 | 1/1986 | Dawson | 272/117 |
| 4,619,453 | 10/1986 | Plumridge | 272/117 |
| 4,709,891 | 12/1987 | Barnett | 248/231.7 |
| 4,747,594 | 5/1988 | Houde | 272/900 X |

FOREIGN PATENT DOCUMENTS

| | | | |
|---|---|---|---|
| 940955 | 1/1974 | Canada | 272/43 |

OTHER PUBLICATIONS

Buckingham, W. "Cable Ready", Exercise for Men Only Jan. 1988, pp. 41–51.

*Primary Examiner*—Richard J. Apley
*Assistant Examiner*—H. Flaxman
*Attorney, Agent, or Firm*—Ratner & Prestia

[57] ABSTRACT

A cable type exercise machine is disclosed in which an adjustable rigid frame designed to fit within the opening of a doorway is secured to the door frame by clamps which exert a compressive force against the casing of the door frame. Weights are attached to the rigid frame by a cable and pulley system. A variety of exercise routines may be performed on this machine.

1 Claim, 4 Drawing Sheets

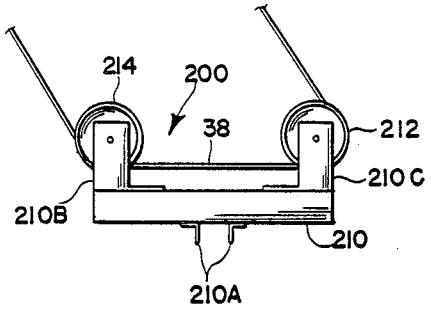
FIG. 2B
FIG. 4
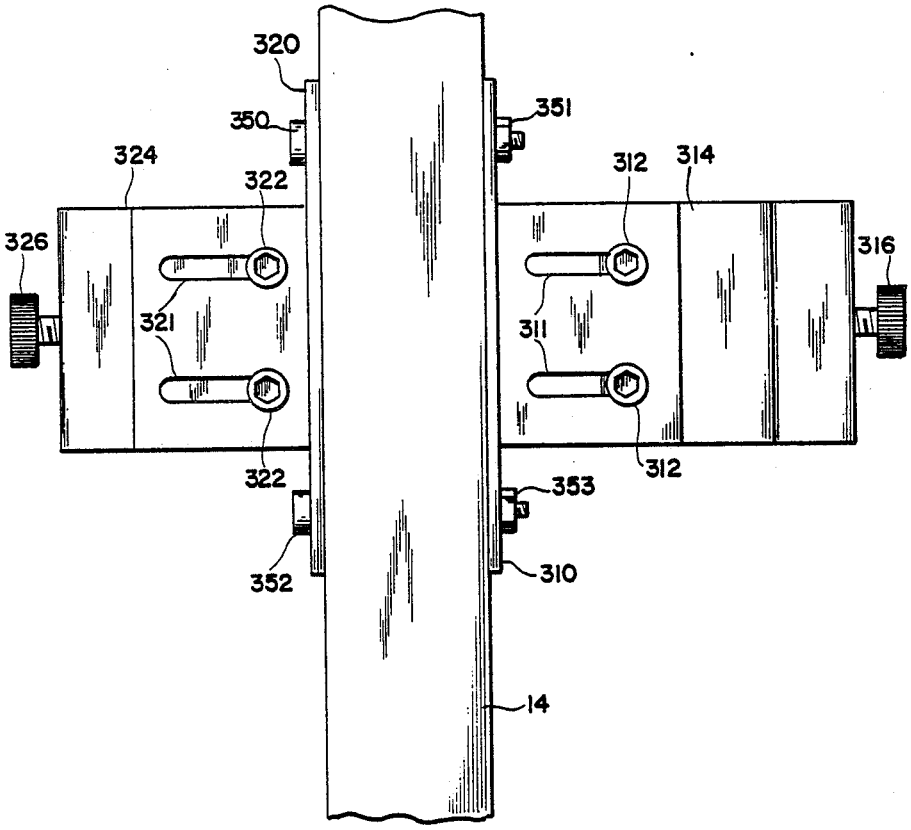

MULTIPLE PURPOSE EXERCISE APPARATUS SUITABLE FOR HOME USE

The present invention relates to exercise apparatus which may be used in a confined area such as an apartment.

In recent years there has been greater public acceptance of the need for a personal routine physical fitness program. The problem faced by many has been inconvenience of integrating sophisticated exercise devices such as are found in a health club or gymnasium a fitness program. To use apparatus of this type one must either travel to a health club or surrender a portion of ones living area to a bulky exercise device designed to be used in a home.

Many exercise devices have been proposed to overcome this problem. One such device is disclosed in U.S. Pat. No. 4,286,782 entitled "Multi-Purpose Exercise Enhancing Device", which is hereby incorporated by reference. This is a free-standing device which is designed to be easily assembled and disassembled so that it may be stored, for example, in a closet when it is not in use. This feature makes the apparatus more convenient than a full sized rigid exercise device for use in a small apartment. This device does have a disadvantage, however, since one must add the time required to assemble and disassemble the apparatus to ones scheduled exercise time.

Another type of exercise device which is designed for use in the home is disclosed in U.S. Pat. No. 4,619,453 entitled "Exercise Device", which is hereby incorporated by reference. This device is designed to be used in a doorway. The exercise device is held in the doorway by pressure exerted against the side jambs of the doorway. The pressure exerted against the sides of the doorway is proportional to the amount of weight suspended from the head structure of the device. If a relatively large weight were suspended from this head member, a large outward force would be exerted against the doorway. This force may damage the doorway.

Few exercise machines that are currently sold are designed to be used by a person who is confined to a wheelchair. One such device is described in U.S. Pat. No. 4,153,244, which is hereby incorporated by reference. This device encloses the wheelchair within a rigid frame upon which are mounted various exercise equipment. This is done to place the exercise equipment within the reach of the individual. This exercise equipment is highly specialized, however, and may not be used easily by other occupants of the individual's house or apartment.

It would be advantageous if an exercise machine could be provided which did not require a large amount of floor space, which did not damage walls or doorways in its normal operation and which could be conveniently used by individuals who are confined to a wheelchair.

SUMMARY OF THE INVENTION

The present invention is embodied in an adjustable exercise machine that is designed to fit inside a doorway and be clamped to the casing of the doorway. The exercise machine includes first and second vertical support members designed to be positioned in close proximity to the side jambs of a doorway. An adjustable transverse member which is coupled to the upper portion of each of the first and second vertical support members may be expanded to a length which approximates the width of the doorway. First and second clamping means are coupled to the first and second vertical support members for holding the vertical members in an upright position in the doorway. The clamping means exert a compression force against the casing of the doorway. Various exercise equipment may be suspended from the transverse member of the frame.

BRIEF DESCRIPTION OF THE DRAWINGS

FIG. 4 is a side plan view of the clamp shown in FIG. 3.

DETAILED DESCRIPTION

Figure 1:
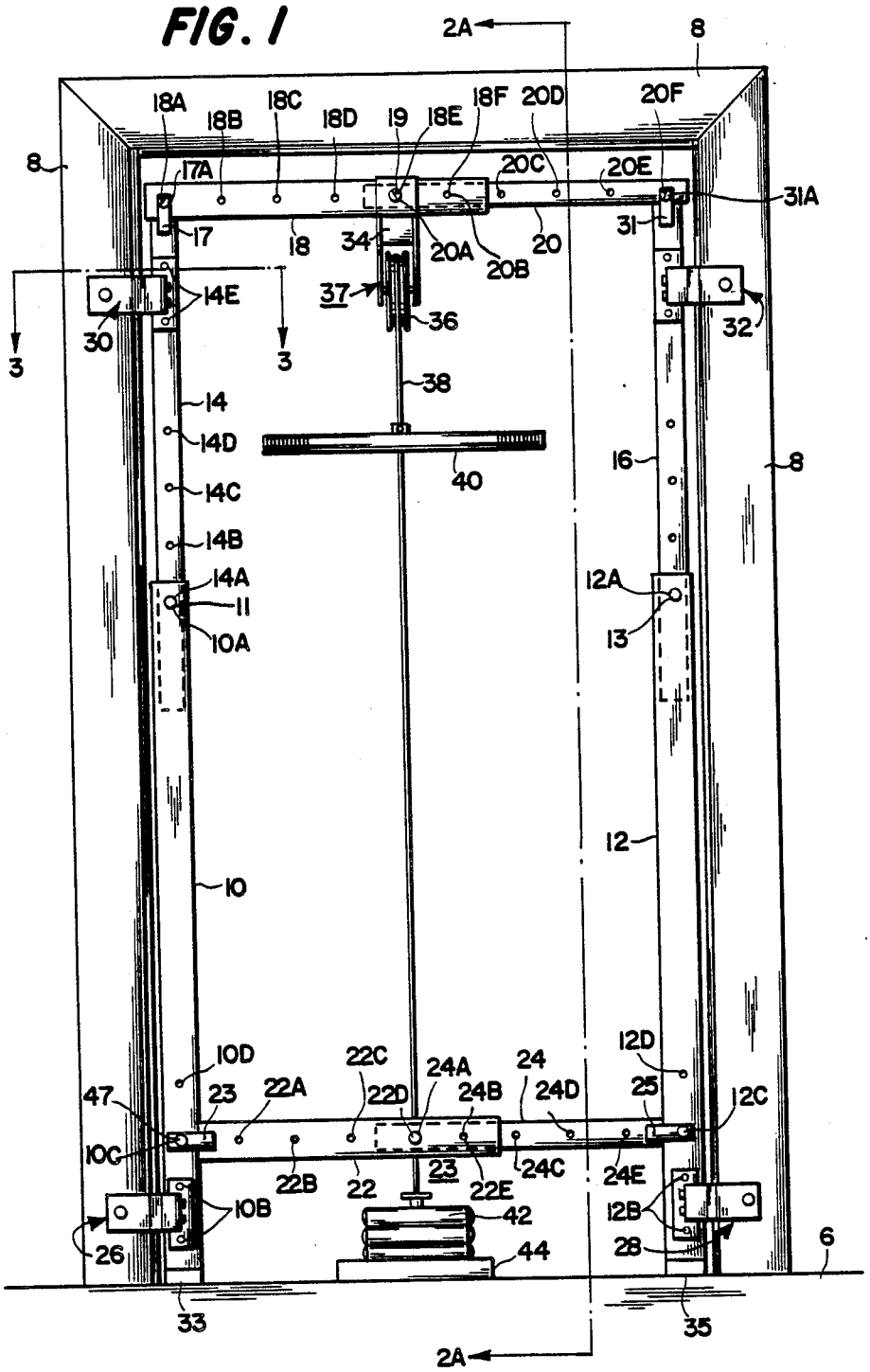
FIG. 1 is a front elevation drawing of exercise apparatus which includes an embodiment of the present invention.

The embodiment of the invention shown in FIG. 1 is an exercise machine commonly referred to as a cable system. In a system of this type, weights 42 are attached to one end of a cable 38. The cable 38 is threaded through a pulley assembly 37 which is supported by a rigid frame. The other end of the cable 38 is coupled to a bar 40 which may be pulled or pushed as a part of an exercise routine. This type of exercise machine is commonly found in gymnasia, see for example an article by W. Buckingham entitled "Cable Ready", Exercise For Men Only, January 1988, pp. 41–48, which is hereby incorporated by reference.

The embodiment of the invention shown in FIG. 1, however, is specifically designed for use in a home or a more confined dwelling such as an apartment. In this embodiment of the invention, the supporting frame for the pulley system is designed to be assembled in an opening such as a closet doorway or other doorway which may remain open. The frame includes two vertical support members and a transverse member. One of the vertical support members includes a hollow lower strut 10 which is telescopically coupled at its top end to an upper strut 14. The bottom end of the strut 10 is configured to receive a rubber or plastic protective pad 33 which cushions the contact between the strut 10 and the floor 6. The strut 10 further includes a hole 10A, which extends through the strut, for securing the upper strut 14 to the strut 10. The combination of the struts 10 and 14 form one upright member of the supporting frame.

In addition to the hole 10A, the strut 10 includes two holes 10B which extend through the strut 10 for securing a clamp 26 to the strut 10. The clamp 26, described below in reference to FIGS. 3 and 4, holds the strut 10 to the inside of the doorway by means of compressive force exerted against the casing, 8, of the doorway. As used in the present application, the term casing refers to the portion of the wall immediately adjacent to the doorway opening. This may be, for example, a wooden molding, plaster or plaster board.

The strut 10 further includes two holes 10C and 10D, which extend through the strut, for attaching an optional lower transverse member 23. The lower transverse member 23 is configured to accept a pulley assembly 200 described below in reference to FIG. 2B.

The upper strut 14 is configured to fit within the hollow lower strut 10. The strut 14 used in this embodiment of the invention has four holes; 14A, 14B, 14C and 14D; which extend through the strut 14. These holes are designed to be aligned with the holes 10A in the strut 10. A connecting pin 11 extends through the holes 10A and one of the holes 14A through 14D to secure the strut 14 to the strut 10. The connecting pin 11 and all other connecting pins used in this embodiment of the invention may be, for example, a type of connector called a locking pin, which is available from Kam Way America Inc. The four holes, 14A through 14D in the strut 14 are provided to enable the height of the vertical support member, formed by the struts 10 and 14, to be changed so that the exercise machine may be used in doorways having different heights.

The strut 14 further includes two holes 14E for securing a clamp 30 which holds the strut 14 to the inside of the doorway. The clamp 30 used in this embodiment of the invention is identical to the clamp 26.

The strut 14 includes a pair of flanges, 17, which, in the present embodiment of the invention, are welded to the front and back of the top end of the strut 14. The flanges 17 allow the strut 14 to be secured to a strut 18 which forms part of the transverse member of the supporting frame of the exercise machine. Each of the flanges 17 includes a hole 17A which is aligned with a hole 18A extending through the strut 18 for coupling the strut 14 to the strut 18 by means of, for example, a bolt and a nut.

The strut 18 used in this embodiment of the invention may be a hollow tube which, in addition to the hole 18A includes holes 18B, 18C, 18D, 18E and 18F that extend through the strut 18. The five holes 18B through 18F serve two purposes in the present invention, to couple the strut 18 to a strut 20 and to serve as mounting holes for the pulley assembly 37. The strut 20 is configured to fit within the strut 18 to form the telescopically adjustable transverse member of the support frame for the exercise machine. The strut 20 includes holes 20A, 20B, 20C, 20D, 20E and 20F which extend through the strut 20. The holes 20A through 20E are evenly spaced and aligned with the respective holes 18B through 18F of the strut 18. This configuration of these holes allows the pulley assembly 37 to be mounted in a number of different positions along the transverse member formed by the combination of the struts 18 and 20. When the pulley assembly 37 is mounted near the center of this transverse member, a connecting pin 19 which holds the pulley assembly to the transverse member may also serve to join the struts 18 and 20. When the pulley assembly is mounted in an off-center position, for example, through the hole 20D, it may be desirable to join the struts 18 and 20 using a bolt and nut assembly.

The hole 20F in the strut 20 used in this embodiment of the invention is for coupling the strut 20 to the second vertical support member which is formed by the combination of a pair of struts 12 and 16. As used in this embodiment of the invention, the strut 12 is the same as the strut 10, and the strut 16 is the same as the strut 14. Accordingly the struts 12 and 16 are not described in detail.

An optional lower transverse member 23 used in this embodiment of the invention includes two telescopically coupled struts 22 and 24. The strut 24 includes evenly spaced holes 22A, 22B, 22C, 22D and 22E extending through the strut and the strut 24 includes corresponding holes 24A, 24B, 24C, 24D and 24E which are evenly spaced and aligned with the holes 22A through 22E. A pulley assembly 200, shown in FIG. 2B, may be mounted on the lower transverse member 23 and the struts 22 and 24 which form the transverse member 23 may be joined in the same manner as described above in reference to the struts 18 and 20.

Figure 2A:
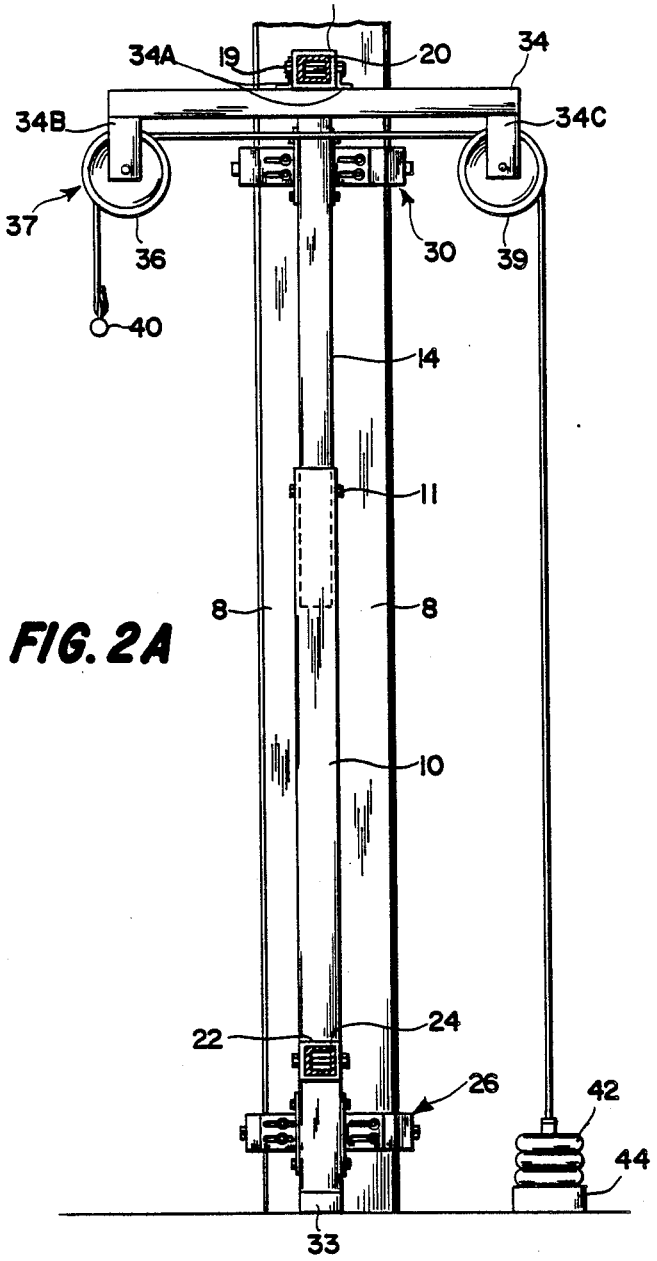
FIG. 2 is a side elevation drawing of a portion of the apparatus shown in FIG. 1.

FIG. 2A is a cutaway view of the exercise frame as indicated in FIG. 1. FIG. 2A illustrates the construction and coupling of the pulley assemblies 37 and 200. The pulley assembly 37 includes a strut 34 having two L shaped brackets, 34A, attached to its top side for mounting the strut 34 perpendicular to and underneath the upper transverse member formed by the struts 19 and 20.

Each of the L shaped brackets 34A has a hole which may be aligned with the holes 18B through 18F and/or 20A through 20D. The strut 34 is coupled to the upper transverse member by means of a connecting pin 19.

The pulley assembly 37 further includes two pulley mounting brackets, 34B and 34C which are attached to the bottom of the strut 34. The bracket 34B is attached at the front end of the strut 34 and the bracket 34C is attached at the back end of the strut. In the present embodiment of the invention, the brackets, 34A, 34B and 34C are attached to the strut 34 by welds. The mounting brackets 34B and 34C are configured to hold conventional pulleys 36 and 39, respectively. The pulleys 36 and 39 are fastened to their respective brackets in a manner which allows them to turn freely. When the exercise machine is in operation, the cable 38 is connected at one end to the weight assmebly 42 and 44, threaded through the pulley 39 and the pulley 36 and coupled at its other end to the bar 40. In this configuration, the cable machine may be used by pulling down and out on the bar 40 to lift the weight assembly 42, 44.

It may be desirable, in some exercise routines, to be able to pull or push the bar 40 in an upward direction, to cause the weight assembly 42, 44 to be raised. The optional pulley assembly 200 is included to facilitate exercise routines of this type. The construction of the pulley assembly 200, shown in FIG. 2B, is similar to that of the pulley assembly 37. A strut 210 includes a pair of L shaped brackets 210A for mounting the pulley assembly onto the optional lower transverse member 23, and pulley mounting brackets 210B and 210C for holding conventional pulleys 214 and 212, respectively. The only differences between the pulley assemblies 37 and 200 are that the pulley assembly 200 is designed to be mounted on the top of the lower transverse member 23 and that the strut 200 is shorter than the strut 34 so that it does not obstruct the weight assembley 42, 44.

In normal operation, the cable machine is configured as described above, and in addition, the cable 38 is threaded from the pulley 36, through the pulleys 212 and 214 of the pulley assembly 200. The bar 40 is coupled to the end of the cable 38 which extends from the pulley 214. In this configuration, an upward motion of the bar 40 causes the weight assembly 42, 44 to move in an upward direction, exerting a force which tends to impede the motion of the bar 40.

Although the pulley assembly 200 is shown in a form similar to the assembly 37, it is contemplated that an alternative pulley assembly may have, for example, a single pulley (not shown) attached by a mounting bracket (not shown) to the lower transverse member 23 by a connecting pin (not shown).

Due to the structure of the cable machine, most of the force exerted by the user is transmitted through the supporting frame to the floor. A relatively small amount of force is transmitted laterally by the frame when the frame is in a true upright position. Nonetheless, this component of force is important. If the frame were not supported in an upright position by the clamps 26, 28, 30 and 32, even a relatively slight lateral force may be sufficient to tip the frame, causing it to fall.

Figure 3:
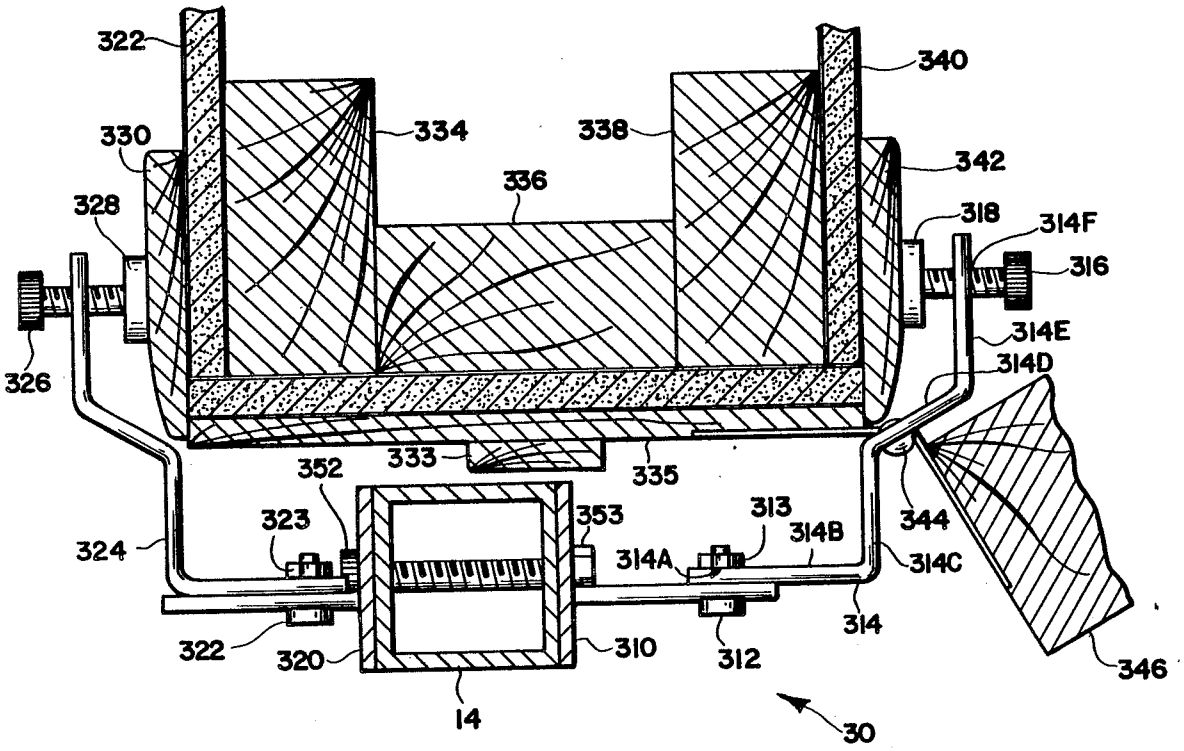
FIG. 3 is a top plan view of one of the clamps used with the apparatus shown in FIGS. 1 and 2.

Details of the clamps 26, 28, 30 and 32 are shown in the FIGS. 3 and 4. FIG. 3 is a cut away view of the clamp 30 as indicated in FIG. 1. In addition to the clamp 30, the FIG. 3 illustrates the structure of one side of a typical door frame. As shown in FIG. 3, the door frame is formed by a jack stud 336 and two casing studs 334 and 338. In the exemplary door frame, pieces of gypsum board 332 and 340 are atached to the respective casing studs 334 and 338. The casing for this doorway is a decorative molding 330 and 342 which may be attached to the casing studs 334 and 338, respectively through the respective pieces of gypsum board 332 and 340. The final parts of the door frame shown in FIG. 3 are a side jamb 335 and a stop 333. A door 346 is atached to the door frame by a plurality of hinges, one of which, 344, is shown in FIG. 3.

The clamp includes first and second fastening members 310 and 320 which are coupled to the strut 14 of the supporting frame by a screw, 352 and a nut 353. A second screw and nut assembly for coupling the fastening members to the frame is not shown in FIG. 3. The fastening members 310 and 320 of the exemplary clamp 30 are in the form of a 'T' where the top of the T is fastened to the strut 14 and the bottom of the T is configured for slidably coupling the fastening members 310 and 320 to respective first and second clamping arm members, 314 and 324.

In this embodiment of the invention, the fastening members 310 and 320 are formed by welding two flat metal pieces together. It is contemplated that other fastening members may be used having two mutually perpendicular segments. These segments may be joined by screws and bolts, rivets, or they may be formed from a single piece of metal by a bending operation.

Each of the fastening members 310 and 320 includes a pair of oblong openings (shown in FIG. 4) for slideably coupling the fastening members to the clamping arm members. Each of the clamping arm members 314 and 324 used in the present embodiment of the invention is formed by bending a single piece of metal. The structure of the clamping arm member is defined in terms of segments, 314B, 314C, 314D and 314E of the clamping arm member 314. The clamping arm member 324 is identical to the clamping arm member 314 and, so, is not described in detail.

The first segment, 314B, includes a pair of holes 314A which are configured to be aligned with the oblong openings in the fastening member 310 to allow the clamping arm member 314 to be coupled to the fastening member 310 by the combination of a pair of screws 312 and a pair of nuts 313. The second segment, 314C, is approximately perpendicular to the segment 314B. The third segment, 314D forms an oblique angle with respect to the segment 314C and is configured to fit through the space between the door 346 and the side jamb 335 when the door is open. The fourth segment, 314E is formed by bending the piece of metal which forms the clamping arm member 314 at an oblique angle with respect to the segment 314D. In the present embodiment of the invention, the angle at the junction of segments 314C and 314D is the same as the angle at the junction of the segments 314D and 314E.

The segment 314E further includes a threaded hole, 314F through which a screw 316 is fitted. The screw 316 has a relatively large knurled head at one end and is coupled at its other end to a pliable plastic pad 318. The plastic pad 318 used in this embodiment of the invention deforms under pressure exerted by tightening the screw 316 to hold the clamp 30 to the door frame by compressive force exerted against the casing 342 of the door frame. Due to the structure of the door frame, considerable force may be exerted by the screw 316 without deforming the doorway. In the door frame shown in FIG. 3, for example, this force is exerted against the casing 330 and 342, gypsum board 332 and 340, the casing studs 334 and 338 and the jack stud 336. All of these are rigid members which resist deformation.

As set forth above, the construction of the clamping arm member 324 used in this embodiment of the invention is identical to that of the clamping arm member 314. In addition, the clamping arm member 324 is coupled to a screw 326 and pliable plastic pad 328 which are identical to the screw 316 and pad 318, respectively. FIG. 4 is a side plan view of the clamp 30 which illustrates how the fastening members 310 and 320 are coupled to the strut 14 and to the respective clamping arm members 314 and 324. The door frame 337 and the door 346 are not shown in FIG. 4 so that the entire clamp 30 may be shown.

In FIG. 4 it is noted that the segments of the exemplary fastening members 310 and 320 which couple the fastening members to the strut 14 extend above and below the segments which couple the respective fastening members to the clamping arm members 314 and 324. This allows easy access to the screw and nut combinations 350, 351 and 352, 353 so they may be tightened without interference from the other parts of the clamp 30.

As set forth above, each of the fastening members 310 and 320 includes a pair of oblong openings for coupling the fastening members to the respective clamping arm members. These openings are shown in FIG. 4. The openings 311 are in the fastening member 310 and the openings 321 are in the fastening member 320. As shown in the FIGS. 3 and 4, the fastening member 310 and the clamping arm member 314 are coupled at a position of maximum extension while the fastening member 320 and clamping arm member 324 are coupled at a position of minimum extension. By adjusting the relative position of the members 320 and 324, door frames wider than the one shown may be accommodated. By adjusting the relative position of the members 310 and 314, door frames narrower than the one shown may be accommodated.

While the clamps 26, 28, 30 and 32 used in this embodiment of the invention each include four adjustments for fitting the clamp to the door frame, it is contemplated that a clamp having fewer adjustments may be used. For example, if the fastening member 320 were combined with the clamping arm member 324 and the screw 326 and pliable pad 328 were replaced by a pliable pad between the combined member and the casing 330, the clamp would be adjustable only by means of the screws 312 in the oblong openings 311 and by means of the screw 316.

The embodiment of the invention shown in FIGS. 1 through 4 is especially suited for use in an apartment because, when the optional lower transverse member 23, the weight assembly 42 and 44 and the cable 38 are removed, the supporting frame may be left attached to the door frame without significantly impeding traffic through the doorway. In addition, since there is no supporting base for the exercise machine shown in FIGS. 1 through 4, there is nothing to block a person who uses a wheelchair from being in a proper position to use the exercise machine.

What is claimed is:

1. A supporting frame, which may be used for an exercise machine, for use in a doorway having first and second sides and having a door mounted on the first side, said supporting frame comprising:

a first vertical support member;

a second vertical support member;

a transverse member, coupled between said first and second vertical support members for positioning said first and second vertical supports members adjacent to the respective first and second sides of the doorway;

first and second clamping means, coupled to said first and second vertical support members, respectively, and to said doorway for holding said respective first and second vertical support members in an upright position inside said doorway by means of a compressive force exerted against respectively different casing sections of said doorway; and wherein said doorway has first and second jambs on said first and second sides, respectively, each of said jambs have a stop member mounted thereon, and said casing sections of said doorway having respective molding sections, wherein, a portion of said first and second clamping means are configured to pass between said door and said doorway to allow said clamping means to hold said exercise supporting frame in an upright position in close proximity to said stop members, inside said doorway by means of said compressive force exerted against the molding sections of said respectively different casing sections of said doorway; and wherein said clamping means include a first member, coupled at a first end to said first vertical support member and at a second to one of the casing sections of said doorway;

wherein said first member includes a first segment configured to be parallel to said one casing segment; a second segment, having an oblique angle with respect to the first segment, for allowing said first member to pass through an opening formed between said one casing section of said doorway and said door, attached to said doorway, when said door is in an open position; and a third segment, having an angle with said second segment that is substantially equal to the angle formed at the junction of said first and second segments; wherein said first segment includes means for coupling said first member to said one casing section of said doorway and said third segment includes means for coupling said first member to said further casing section of the doorway; and wherein the clamping means further includes a second member, coupled at a first end to said first member and a second end to a further casing section opposite said one casing section, wherein said first member exerts a compressive force against said one casing section and said second member exerts a compressive force against said further casing section; and wherein said transverse member includes means for coupling exercise apparatus to said supporting frame.

* * * * *